US007726535B2

(12) United States Patent
Jönsson et al.

(10) Patent No.: US 7,726,535 B2
(45) Date of Patent: Jun. 1, 2010

(54) STAPLER

(75) Inventors: Ulf Jönsson, Hyltebruk (SE); Lars-Inge Magnusson, Hestra (SE); Frank Ambjörnsson, Hestra (SE); Trygve Gustavsson, Asenhöga (SE)

(73) Assignee: Isaberg Rapid AB, Hestra (SE)

( * ) Notice: Subject to any disclaimer, the term of this patent is extended or adjusted under 35 U.S.C. 154(b) by 343 days.

(21) Appl. No.: 11/579,443

(22) PCT Filed: Apr. 13, 2005

(86) PCT No.: PCT/SE2005/000522

§ 371 (c)(1),
(2), (4) Date: Aug. 17, 2007

(87) PCT Pub. No.: WO2005/105397

PCT Pub. Date: Nov. 10, 2005

(65) Prior Publication Data

US 2008/0265000 A1 Oct. 30, 2008

(30) Foreign Application Priority Data

May 5, 2004 (SE) ..... 0401158

(51) Int. Cl.
*B25C 5/15* (2006.01)

(52) U.S. Cl. ..... 227/131; 227/119; 227/136; 227/155

(58) Field of Classification Search ..... 227/82, 227/88, 83, 119, 131, 136, 155
See application file for complete search history.

(56) References Cited

U.S. PATENT DOCUMENTS

| | | | | |
|---|---|---|---|---|
| 3,348,752 | A | 10/1967 | Wheble | |
| 4,641,772 | A | 2/1987 | Skuthan | |
| 4,693,407 | A | 9/1987 | Buck et al. | |
| 5,560,529 | A * | 10/1996 | Udagawa et al. | 227/136 |
| 5,702,047 | A * | 12/1997 | Yoshie | 227/131 |
| 5,794,833 | A * | 8/1998 | Strååt | 227/137 |
| 5,873,509 | A | 2/1999 | Liao | |
| 6,050,471 | A * | 4/2000 | Yagi | 227/119 |
| 6,257,477 | B1 | 7/2001 | Strååt | |
| 6,371,351 | B1 * | 4/2002 | Magnusson | 227/119 |
| 7,243,830 | B2 * | 7/2007 | Kitamura et al. | 227/82 |

FOREIGN PATENT DOCUMENTS

| | | |
|---|---|---|
| EP | 0216218 A2 | 4/1987 |
| GB | 745458 | 2/1956 |

* cited by examiner

*Primary Examiner*—Rinaldi I. Rada
*Assistant Examiner*—Nathaniel Chukwurah
(74) *Attorney, Agent, or Firm*—Miles & Stockbridge P.C.

(57) ABSTRACT

A stapler for stapling together a workpiece, primarily a sheaf of papers, in which the stapler comprises a stapling unit and an anvil, which interacts with the stapling unit and on which the workpiece is placed, and against which stapling is performed, which stapling unit and an anvil are, driven relative to each other in a reciprocating stapling movement, during which movement stapling takes place, the stapling unit comprises a frame and a staple cassette which houses staple blanks and which is exchangeable, and which is detachably connected to the frame by attachment devices, and the staple blanks are fed one by one to an outlet channel by a feeding device incorporated in the stapler.

23 Claims, 15 Drawing Sheets

VIEW A-A

VIEW B-B

VIEW C-C

STAPLER

TECHNICAL FIELD

The present invention relates to a stapler for stapling together a workpiece, primarily a sheaf of papers, in which the stapler comprises a stapling unit and an anvil which interacts with the stapling unit and on which the workpiece is placed, and against which stapling is performed, which stapling unit and anvil are driven by means of a drive means in a reciprocating stapling movement relative to each other, during which movement stapling takes place, wherein the stapling unit comprises a frame and a staple cassette which houses staple blanks and which is exchangeable, and which is detachably connected to the frame by attachment devices, wherein the staple blanks are fed one by one to an outlet channel by a feeding device incorporated in the stapler, through which outlet channel a staple which has been fed and formed into staple shape during the stapling movement is driven by a blade-shaped driver incorporated in the stapler to staple the workpiece, which driver is driven by the drive means and acts on the staple crown, wherein the outlet channel is, in the direction which is transverse to the longitudinal direction of the staple crown, defined by a first guide surface provided with a first face disposed on the staple cassette and a second guide surface provided with a second face disposed on the frame, which faces guide the staple as it is driven through the outlet channel, the clearance between the faces of the outlet passage being determined by spacing elements.

STATE OF THE ART

Staplers of the type described above have long been known and commonly existed. The applicant's own, earlier patent, U.S. Pat. No. 5,794,833, which shows an apparatus of this type in all essential respects, may be cited as just one example.

However, the disadvantage of earlier apparatuses is that the use of releasable fasteners to attach the staple cassette to the frame may, due to manufacturing tolerances, easily cause failure of the fasteners to attach the cassette securely to the frame, with the result that the distance between the faces of the outlet passage may be bigger than that permitted by the spacing elements, causing the driver, when driving the staple, to lose grip with the staple crown, with the result that the staple is not driven sufficiently into the workpiece, leading to failure to achieve satisfactory stapling or, in the worst case, no stapling whatever. Since the location of the outlet channel is such that is not visible, the fault cannot be observed and corrected before stapling is carried out and, if faulty stapling is discovered, it is impossible to ascertain with certainty that that the fault is due to a faulty outlet channel since this can be observed only with great difficulty.

Problem

Thus, there exists a need for a stapler of the type described above in which the first and the second guide surfaces are maintained in a position such that the distance between them does not exceed that determined by the spacing elements and which distance is maintained even if greater manufacturing tolerances occur in the component parts.

Solution

The present invention provides a solution to the aforementioned problems by means of a stapler of the type described above, which is characterised in that the guide surfaces are movable toward and away from each other relative to each other and that they are pressed toward each other using one or more elastic elements.

The present invention is also characterised in that the second guide surface is movable in a direction toward and away from the first guide surface and that it is moved toward the first guide surface by incorporated elastic means when the staple cassette is fitted to the frame.

The present invention is further characterised in that the second guide surface is, when the staple cassette is not attached, moved by included elastic means ahead of the position in which it is located when the staple cassette is attached.

The present invention is further characterised in that the incorporated elastic means consist of helical springs.

BRIEF DESCRIPTION OF FIGURES

The present invention will hereinafter be described with reference to the appended figures, of which.

PROPOSED EMBODIMENT

Figure 1:
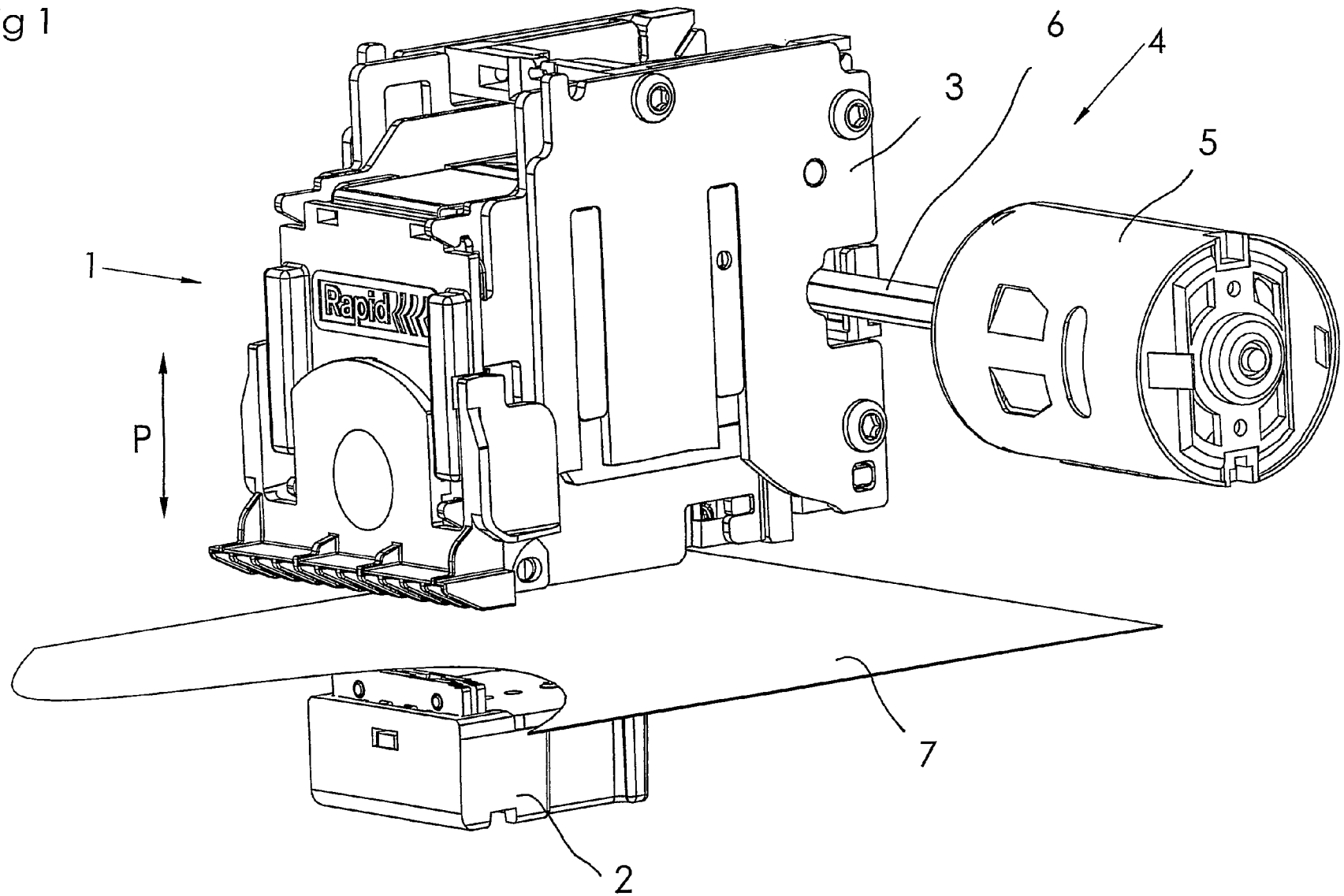
FIG. 1 is a general view of a stapler according to the present invention.

FIG. 1 is a general view of a stapler 1 according to the present invention. The stapler comprises an anvil 2 and a stapling unit 3.

The anvil surface and stapling unit are, in known manner, connected by connecting means which are not shown in the figure, but which enable the anvil and stapling unit to be moved toward and away from each other in a reciprocating stapling movement, which movement is indicated by the double arrow P. The connecting means may consist of parts included in the equipment to which the stapler is attached or may be part of the stapler. The stapling movement is achieved using a drive means 4, which comprises an electric motor 5 connected to the stapling unit 3 by a transmission shaft 6. It will be clear to one skilled in the art that the electric motor 5 may also be integrated in the stapling unit. The figure also shows the workpiece 7 to be stapled, the said workpiece being placed on the anvil 2 against which stapling is performed.

Figure 2:
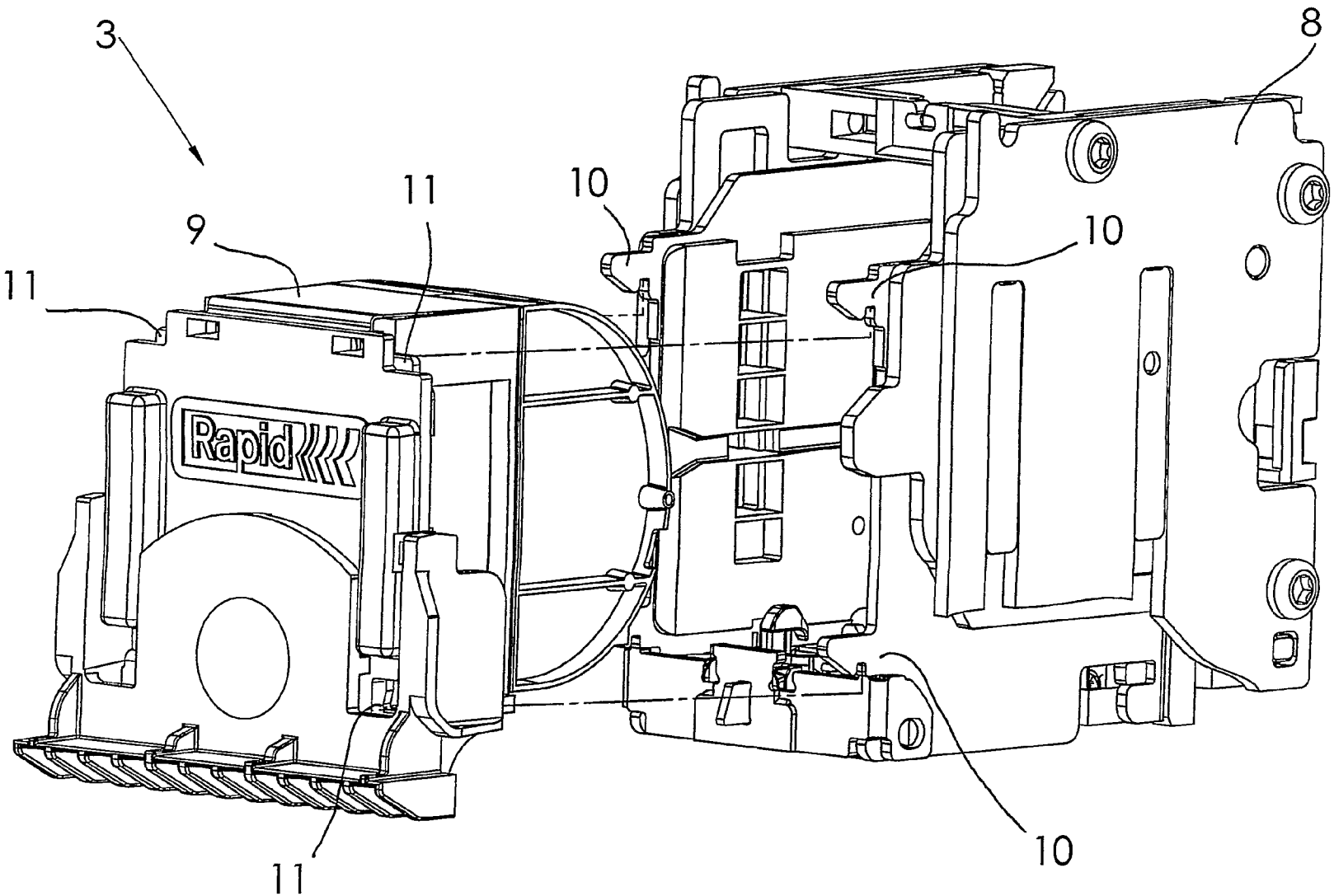
FIG. 2 is a general view of a stapling unit comprising part of the present invention, in which view the staple cassette included in the invention is exposed.

FIG. 2 shows the stapling unit 3, which comprises a frame 8 and a staple cassette 9. The frame comprises attachment devices 10, only three of which are visible in the figure, and these are connected to connection areas 11 provided on the staple cassette when the cassette is fitted to the frame.

Figure 3:
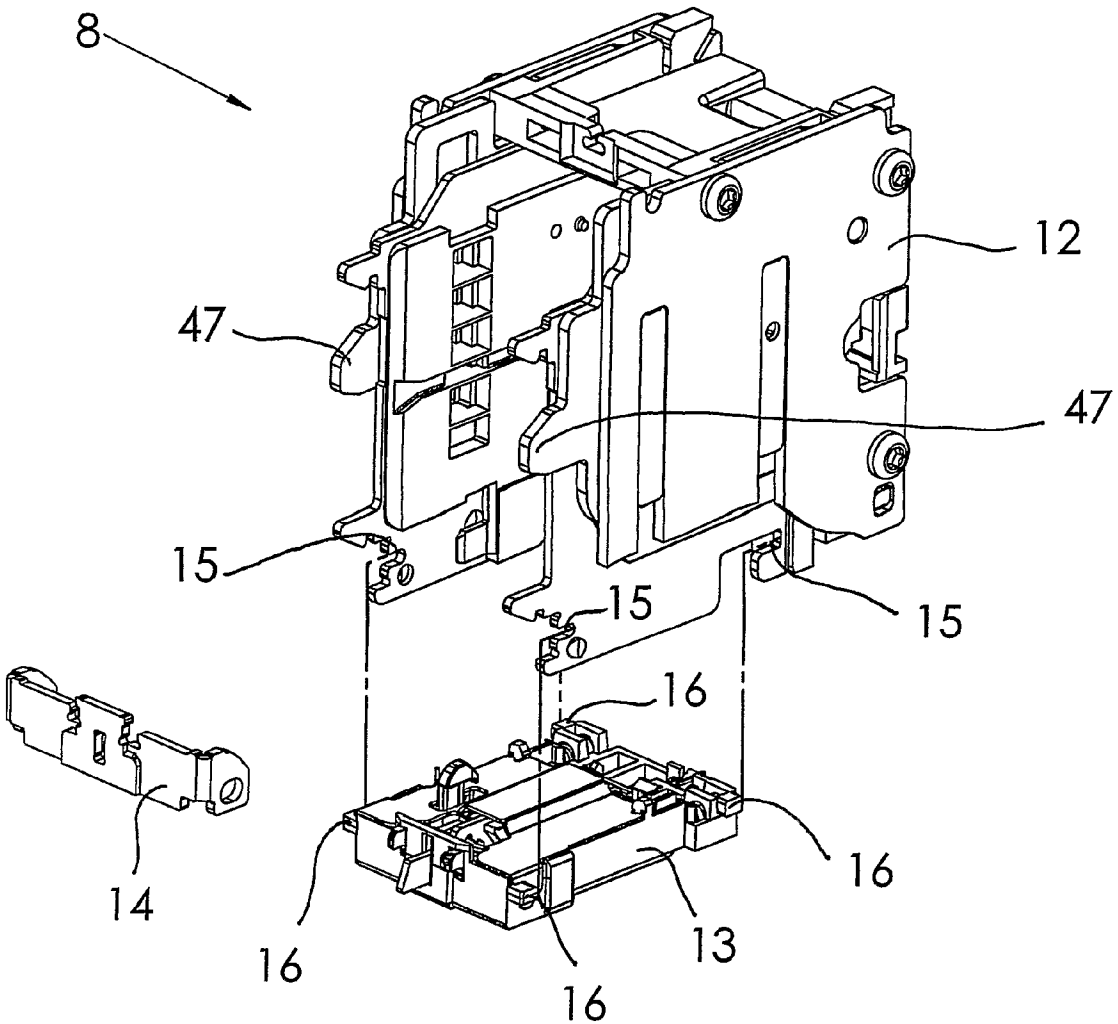
FIG. 3 is a view showing a frame comprising part of the stapling unit with the feeding device and forming block separate from the frame.
Figure 4:
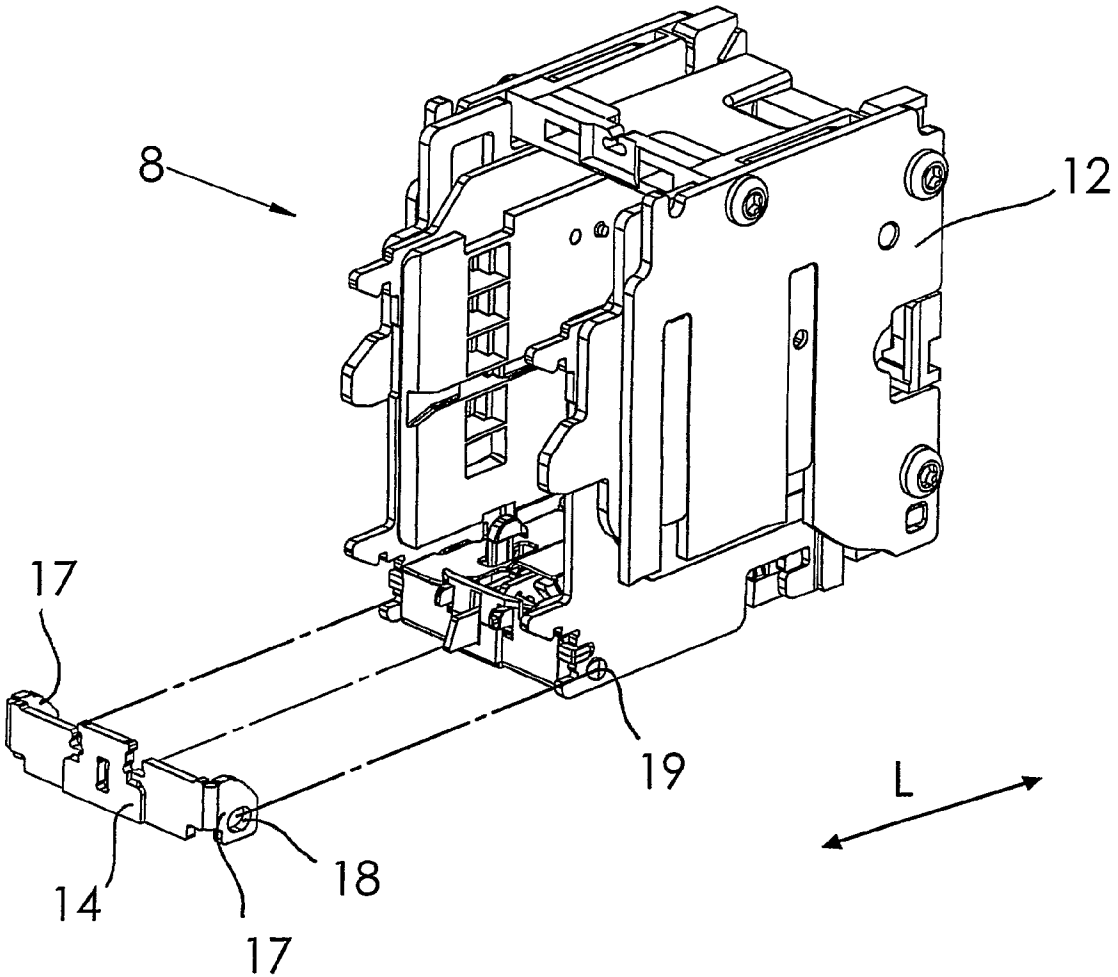
FIG. 4 is a view corresponding to FIG. 3 in which the feeding device is shown assembled with the frame.
Figure 5:
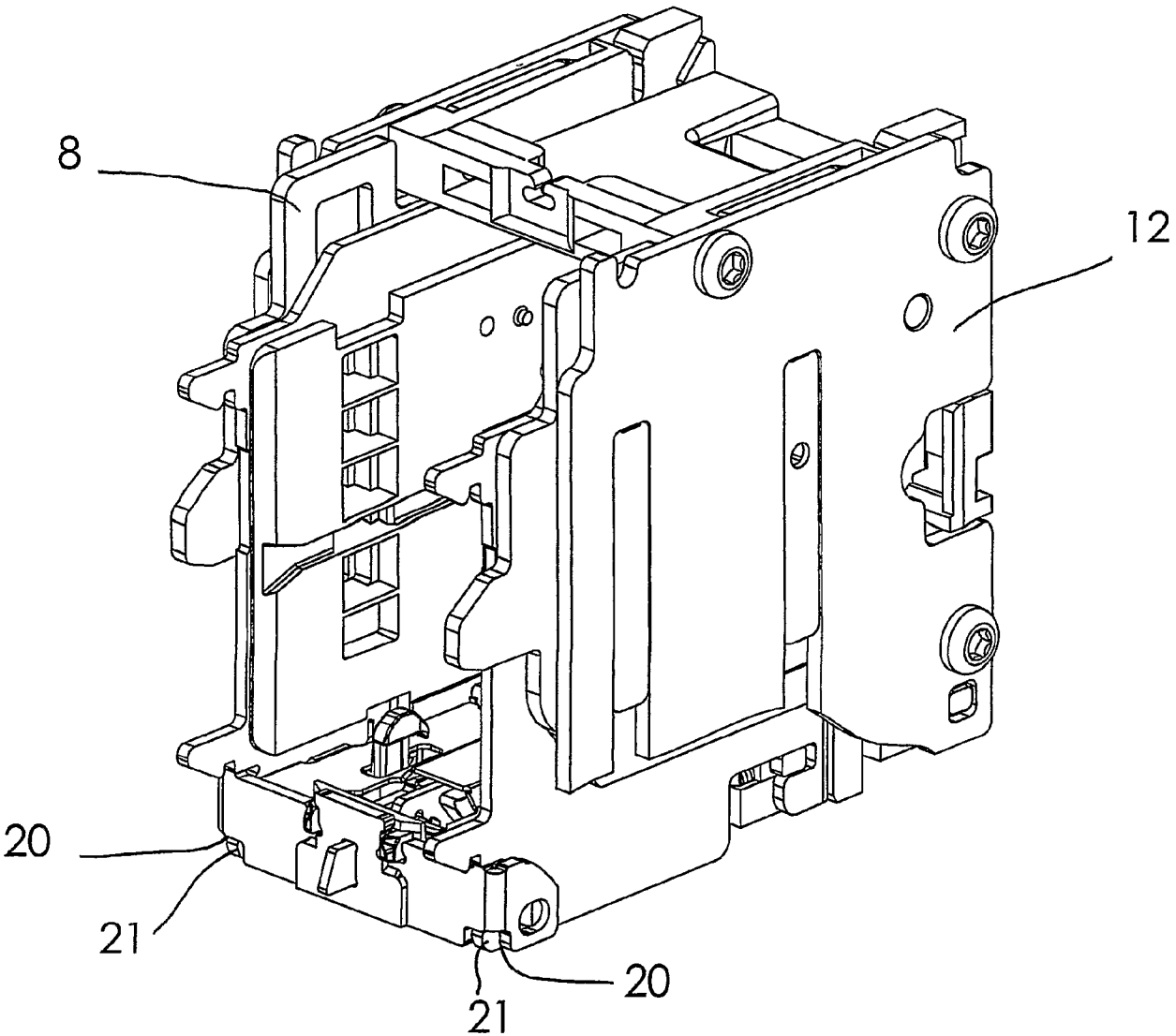
FIG. 5 is a view corresponding to FIGS. 3 and 4 in which the forming block is also shown assembled with the frame.

The construction of the frame 8 is shown in greater detail in FIGS. 3-5. In the figures, the lower parts of the side wall 12 facing the viewer have been omitted solely to enable the invention to be described more clearly. The feeding device 13 and the forming block 14 included in the frame are shown broken out in FIG. 3, while the feeding device is shown connected to the frame in FIG. 4 and the forming block is also shown connected to the frame in FIG. 5. As is shown most clearly in FIG. 3, the frame is provided with slots 15, only three of which are shown in the figure, in which studs 16 arranged on the feeding device 13 are engaged when the feeding device is connected to the frame. The studs 16 are, in known manner, arranged relative to the slots 15 so that they can be moved along the said slots, which means that the feeding device is movable relative to the frame in the direction indicated by the double arrow L in FIG. 4. The forming block 14 is provided with connecting lugs 17 in which are provided elongated openings 18, of which only one is visible in the figures, while the frame is provided with protrusions 19, of which only one is likewise shown in the figures. The forming block is mounted on the frame by straddling the frame with the lugs 17 and snapping the said lugs over the protrusions 19, whereupon the openings 18 enclose the protrusions 19. Since the openings 18 are elongated, the forming block is, in similar manner to the feeding device, enabled to move relative to the frame in the direction indicated by the double arrow L. When the forming block is fitted to the frame, the forming block is prevented from pivoting downward about the protrusions 19 by the interaction of stop surfaces 20 arranged on the forming block with projections 21 arranged on the frame.

Figure 10:
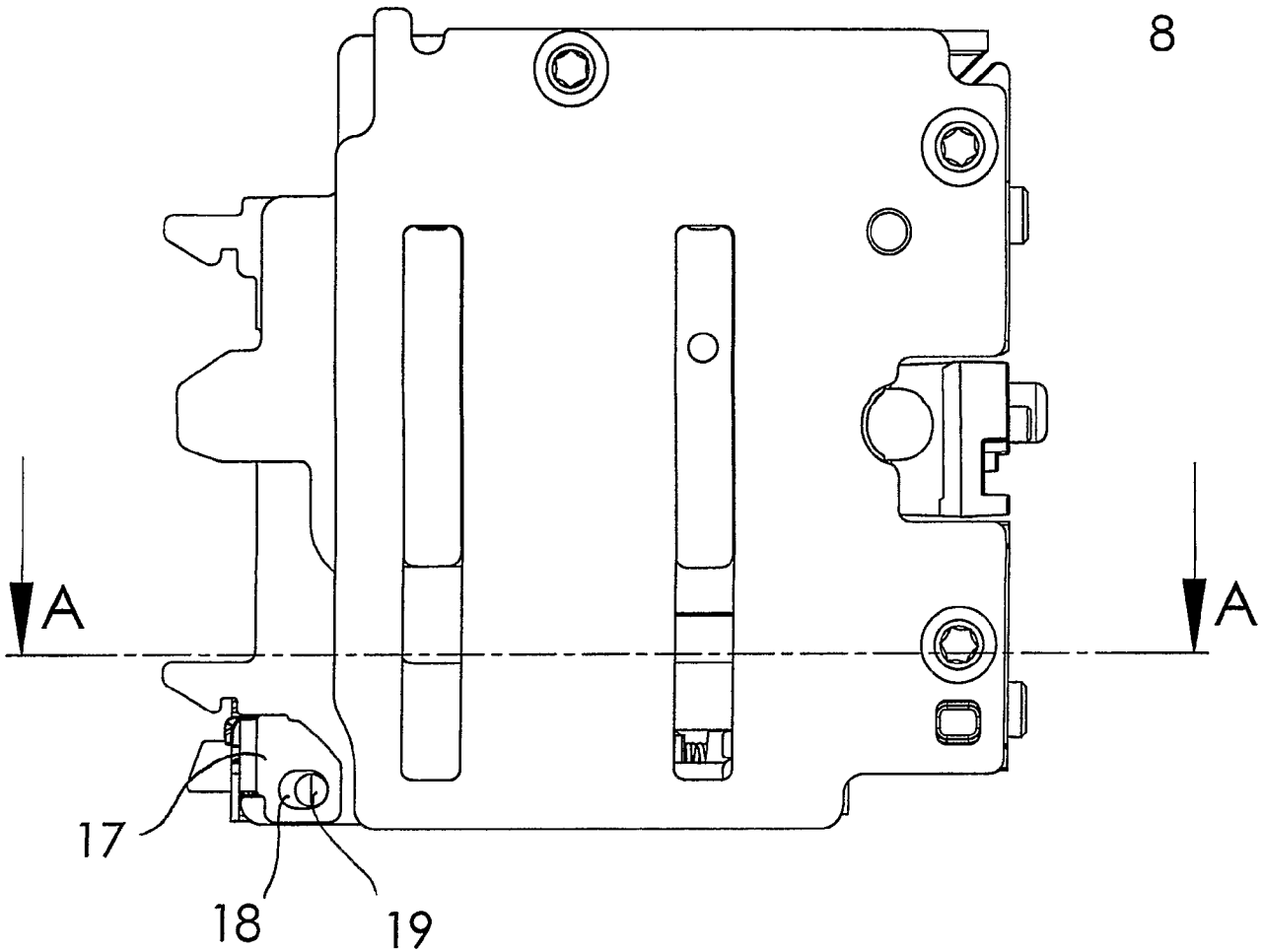
FIG. 10 shows the stapling unit seen from the side.
Figure 11:
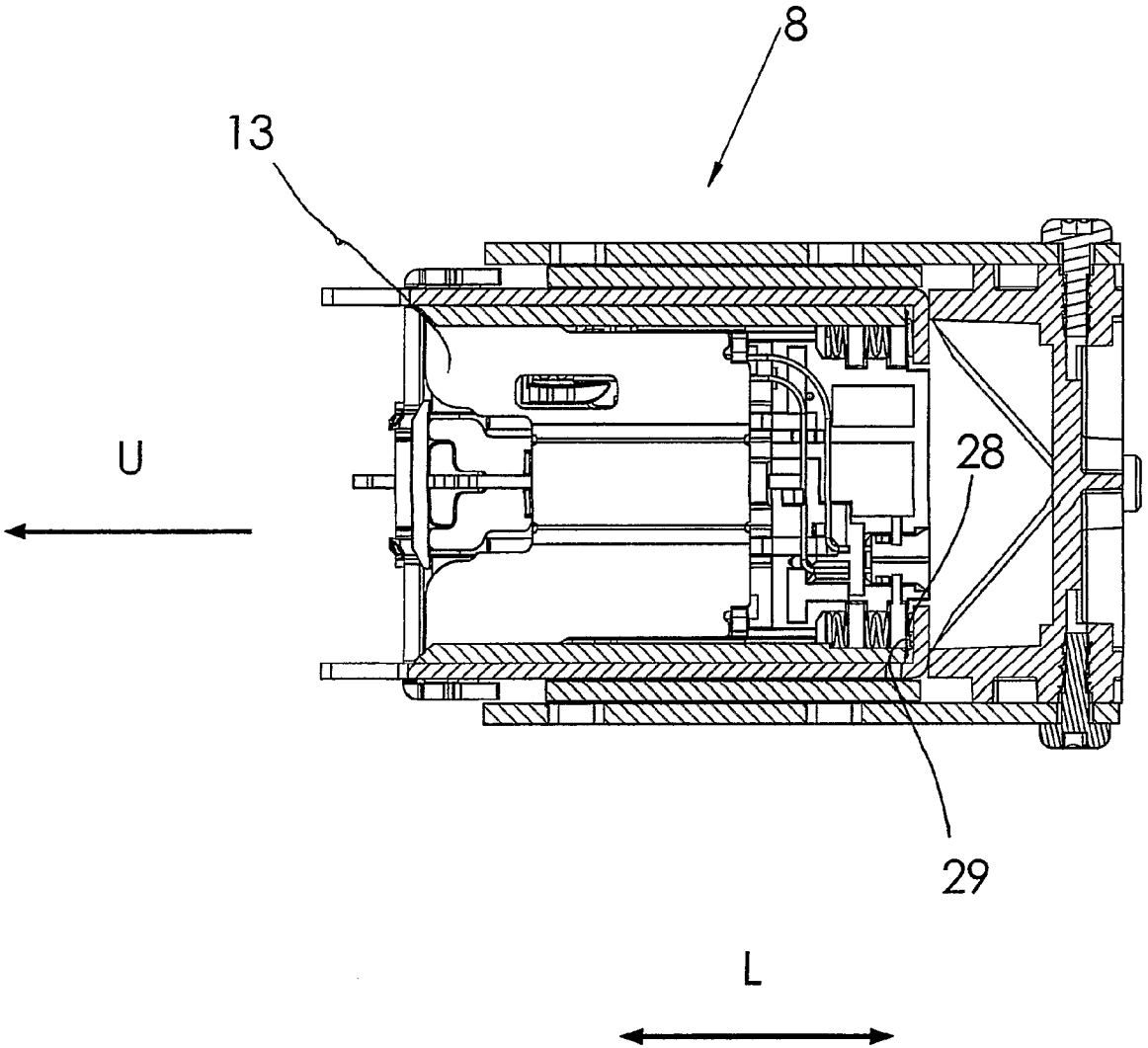
FIG. 11 is a view through section A-A in FIG. 10.
Figure 12:
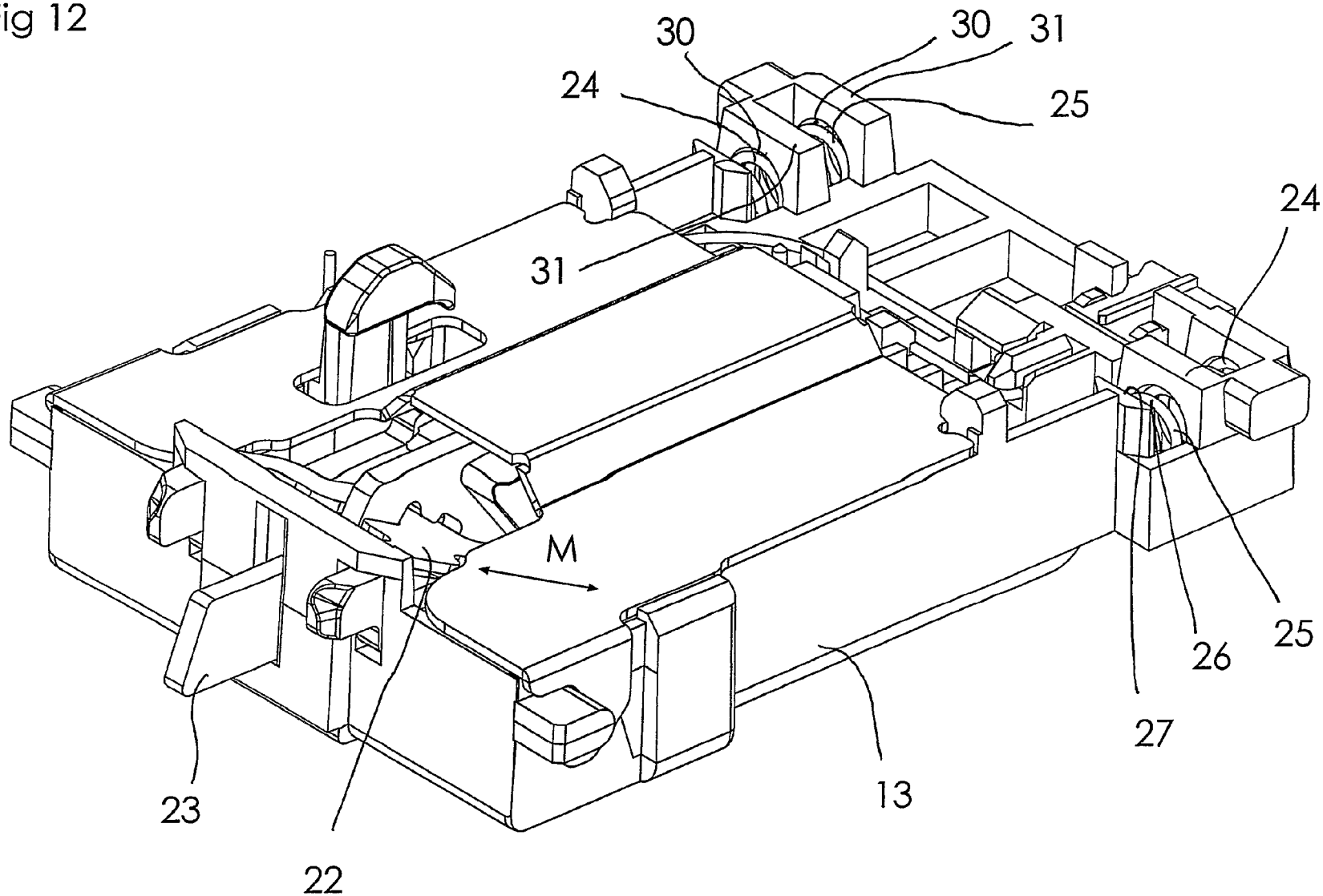
FIG. 12 is an enlarged view of the feeding device shown in FIG. 3.

FIG. 12, which is an enlarged view of the feeding device 13, shows that the feeding device comprises, in known manner, a feeding tab 22 which, in known manner, is in connection with and acted upon by a slide 23. The functions of the tab 22 and slide will be described below. FIGS. 11 and 12 show that the feeding device 13 is provided, at the rear, with elastic elements 24 in the form of helical springs 25, each of which is, at a first end 26, in engagement with a first seat 27 arranged on the feeding device and, at a second end 28, in engagement with a second seat 29 arranged on the frame. To ensure that the helical springs 24 act in the axial direction, the springs extend through openings 30 in walls 31 arranged in the feeding device 13 between the respective ends 26 and 28 of the springs. As shown in FIG. 11, the helical springs 24 press the feeding device 13 and the forming block 14 in the direction indicated by the double arrow L in a direction away from the frame as indicated by the arrow U in FIG. 11 and this movement is limited, when the staple cassette is not fitted to the frame, by the fact that the elongated openings 18 in the forming block enter into engagement with the protrusions 19 in the manner shown in FIG. 10, thereby preventing further outward displacement in the direction U. Although the elastic elements are shown in the figures as two separate items, it will be clear to one skilled in the art that it is sufficient to use only one elastic element which, in that case, should be located along the centre line of the feeding device or alternatively, more than two elastic elements can be used to achieve the effect described above.

Figure 6:
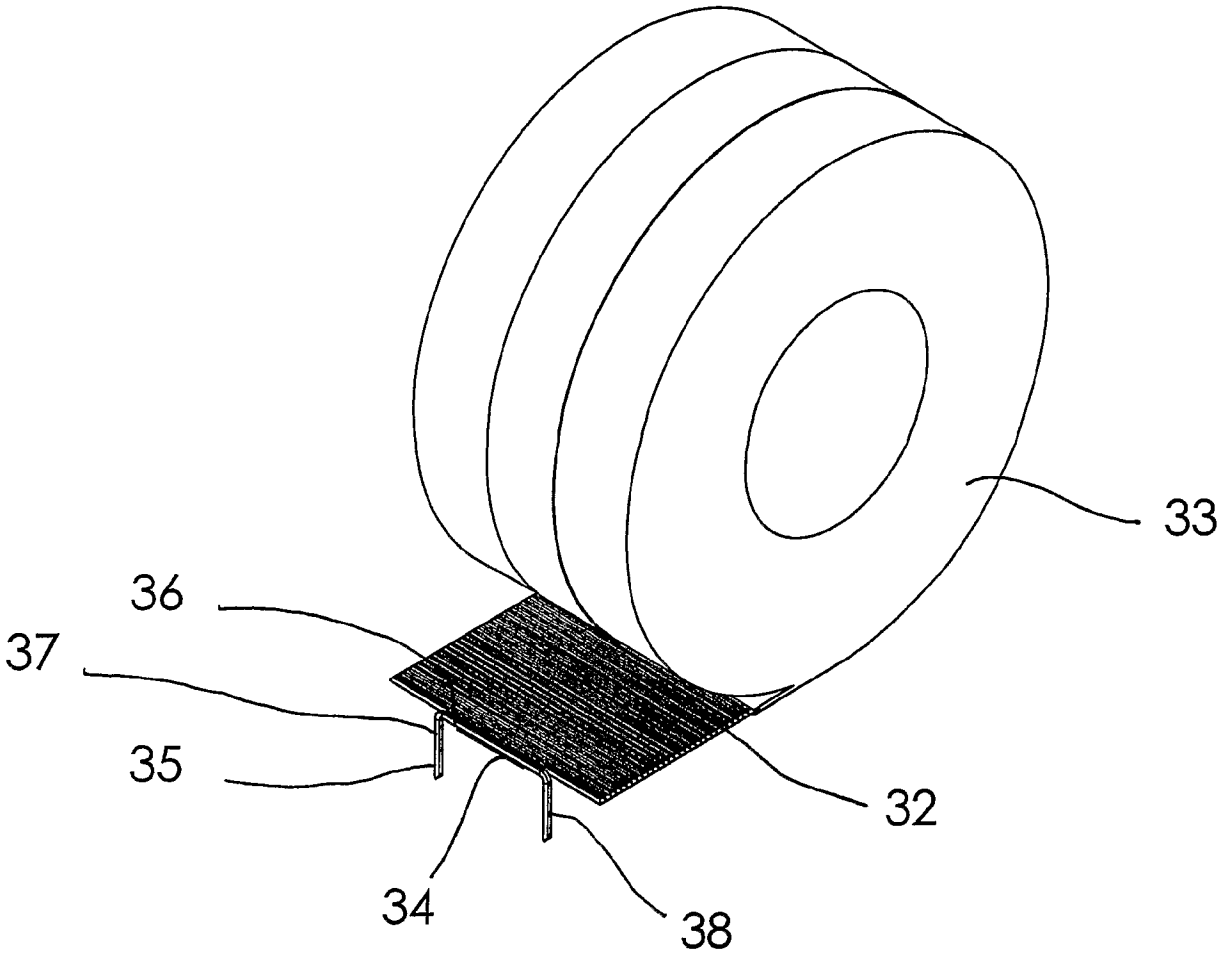
FIG. 6 shows a roll of staples in the form of staple blanks which is to be stored in the staple cassette.
Figure 7:
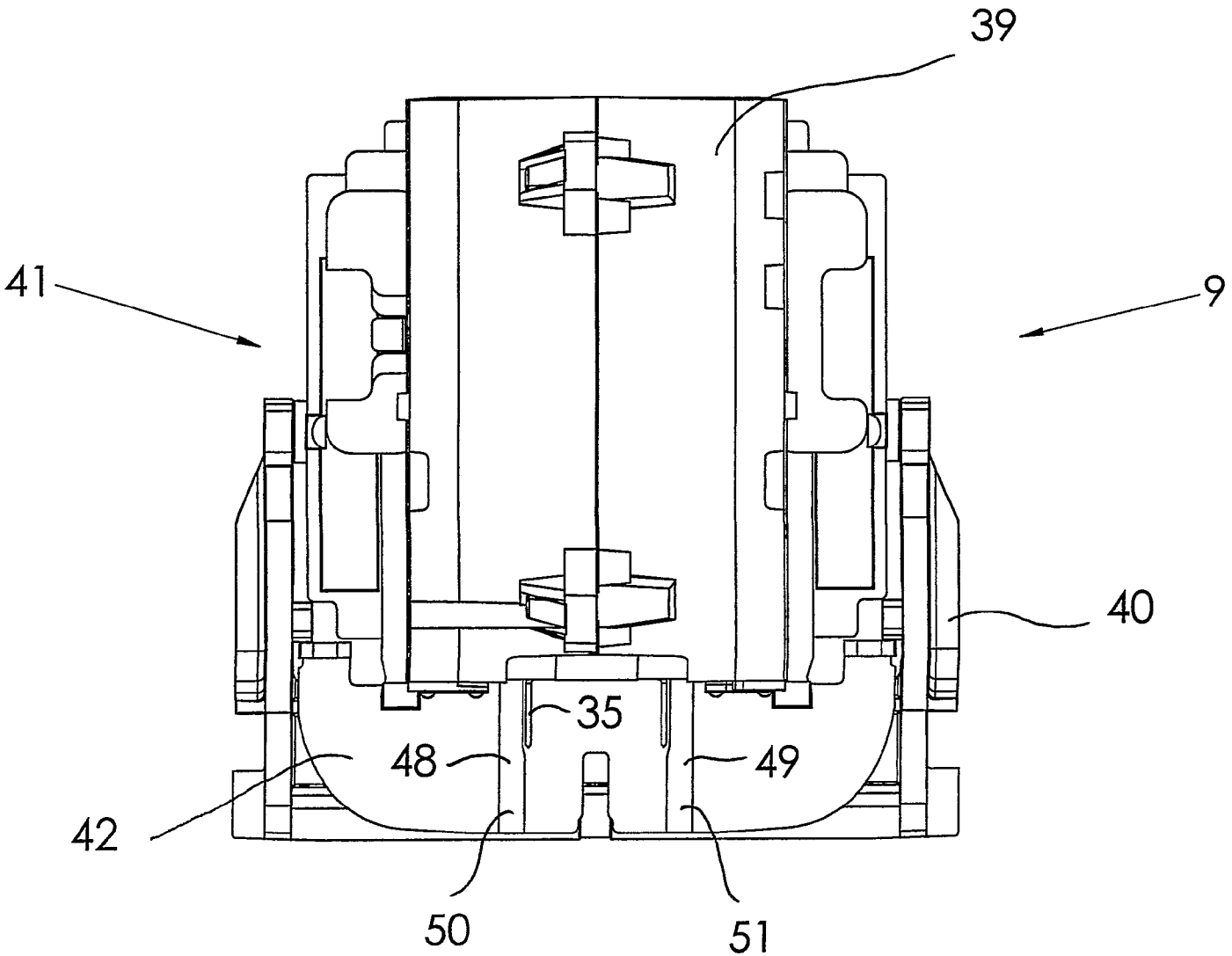
FIG. 7 shows a staple cassette, seen from the side, fitted to the frame.
Figure 8:
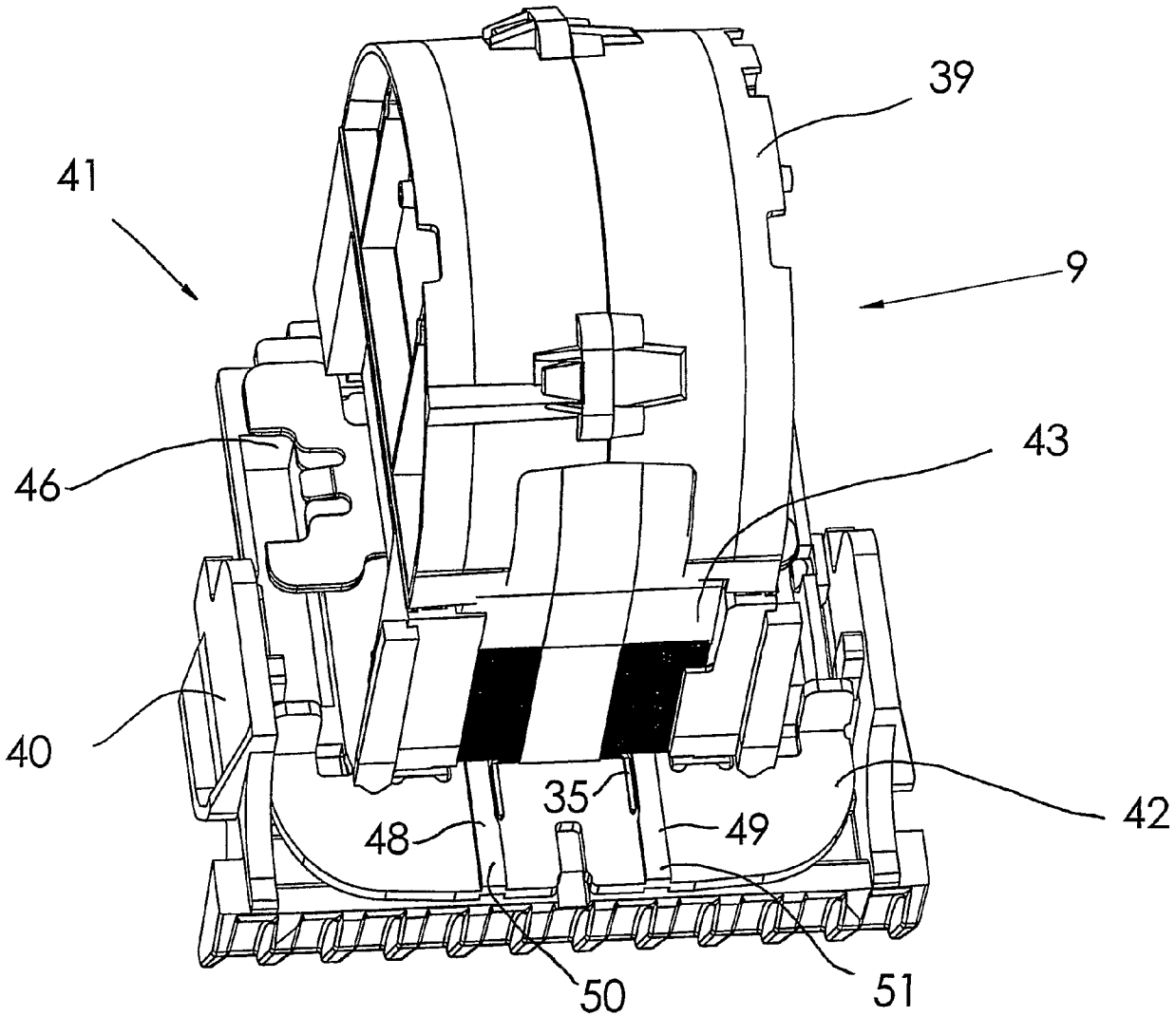
FIG. 8 shows a staple cassette, seen at an angle from underneath, from the side fitted to the frame.
Figure 9:
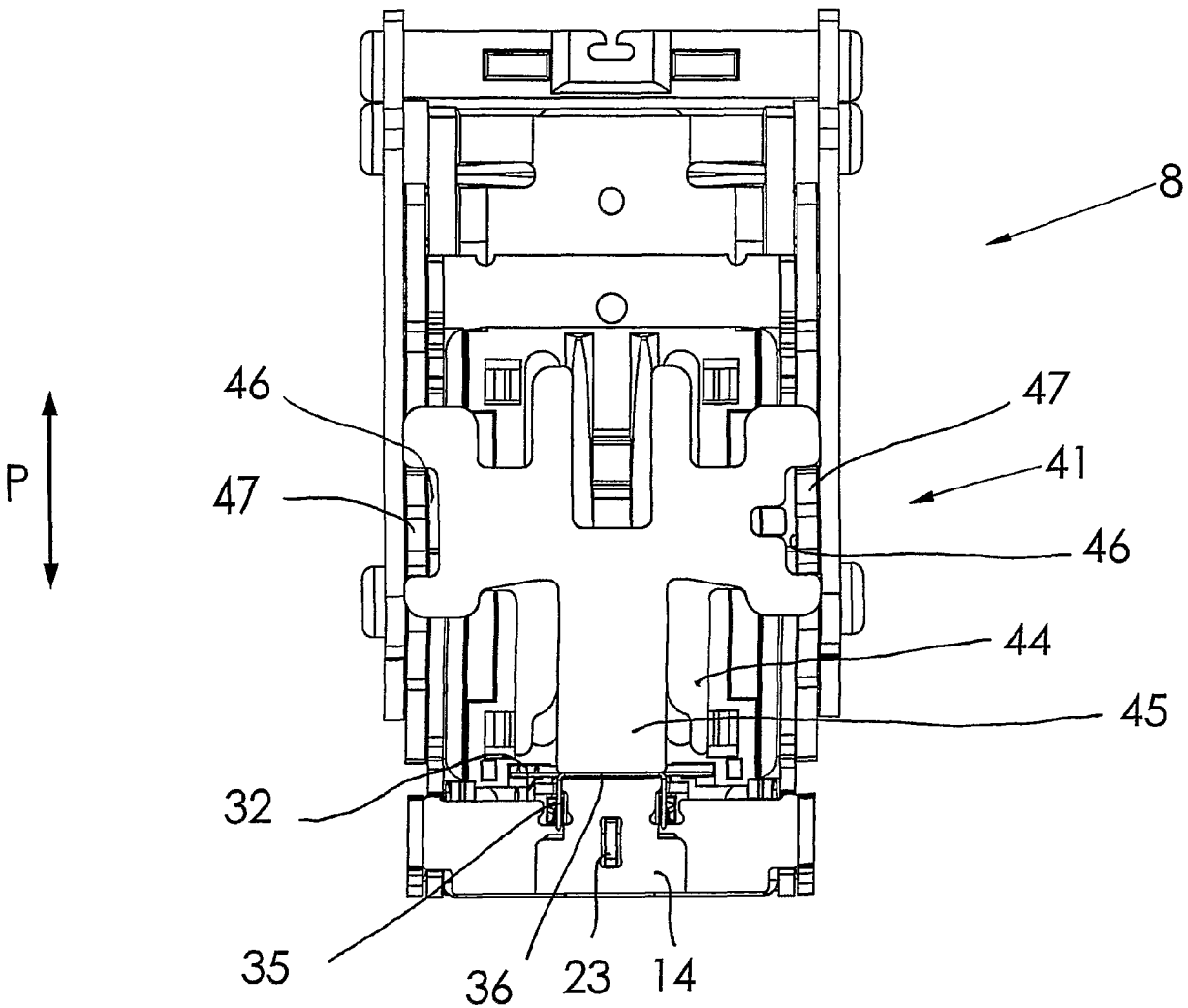
FIG. 9 shows the stapling unit according to the present invention, seen from straight in front and with parts of staple cassette omitted.

FIG. 6 shows the staple roll 33, which consists of staple blanks 32 which, by means of a connecting tape 34, are joined in the form of a strip and coiled into the form of a roll 33. In the figure, the first staple blank is shown in the form of a staple 35 bent into staple form, comprising a crown 36 and a first leg 37 and a second leg 38. In FIGS. 7 and 8, the staple cassette 9 is seen from the side that is fitted to the frame 8. The cassette comprises a magazine 39, in which the staple roll 33 is housed, and a front part 40. The front part 40 encloses a staple forming and driving arrangement 41 which, in known manner, is disposed on a front plate 42 comprising part of the front part and whose function will be clear from the further description below. FIG. 8, shows that the magazine 39 is provided with an opening 43 through which the staple roll is accessible. In FIG. 9, which shows the stapling unit 3 from the front, the front parts of the cassette have been omitted and the figure shows the staple forming and driving arrangement 41, which comprises a forming punch 44 and a blade-shaped driver 45. Both the forming punch and driver are provided with cutouts 46, see FIG. 8, which interact with drive links 47 arranged in the frame, see FIG. 3. The drive links are in connection with and are driven by the drive means 4 as part of the reciprocating stapling movement P in a manner which will be clear to one skilled in the art. When the driver and forming punch are driven downward by the drive links, the forming punch 44 forms the staple blank immediately to the inside of the outermost staple blank into staple form 35 over the forming block 14, while the front staple blank, which has previously been formed into staple form by the driver, is driven downward in the direction of the workpiece, which workpiece is shown in FIG. 1.

The function of the forming punch 44, driver 45 and feeding device 13 will be described with reference to FIGS. 2, 5, 7, 9 and 12. Since this function is basically not part of the invention, and since it is also already generally known, it will be described only in general terms. When the cassette 9 is fitted to the frame 8, the magazine 39 is placed in the frame and the front part 40 of the cassette is attached to the frame by the attachment devices 10. At the same time, the drive links 47 are engaged in the cutouts 46 and the feeding tab 22 comes in contact with the staple roll 33 through the opening 43. When the drive links 47 drive the forming punch 44 and driver 45 downward in the course of a stapling movement, the driver meets the staple crown 36 and then the slide 23 which is then moved into the feeding device 13 in opposition to the force exerted by an elastic element (not shown), causing the feeding tab 22 to move downward in the feeding device in the direction indicated by the double arrow M in FIG. 12 and out of engagement with the staple roll 33. When the driver is returned to the original position by the drive links, the slide 23 is moved to its original position and the feeding tab is lifted by the elastic means into contact with the staple roll, feeding the staple strip forward by the width of a staple. As a result, a new, bent staple is moved into the position in which it is driven by the driver in the direction of the anvil 2.

FIGS. 7 and 8 show that the staple 35 which has been formed into staple form is fed forward into contact with the front plate 42 and that the front plate is provided with guide strips 48,49, which guide the staple laterally when it is driven by the driver and which also act as spacing elements 50,51 with a function which will be clear from the further description below.

Figure 13:
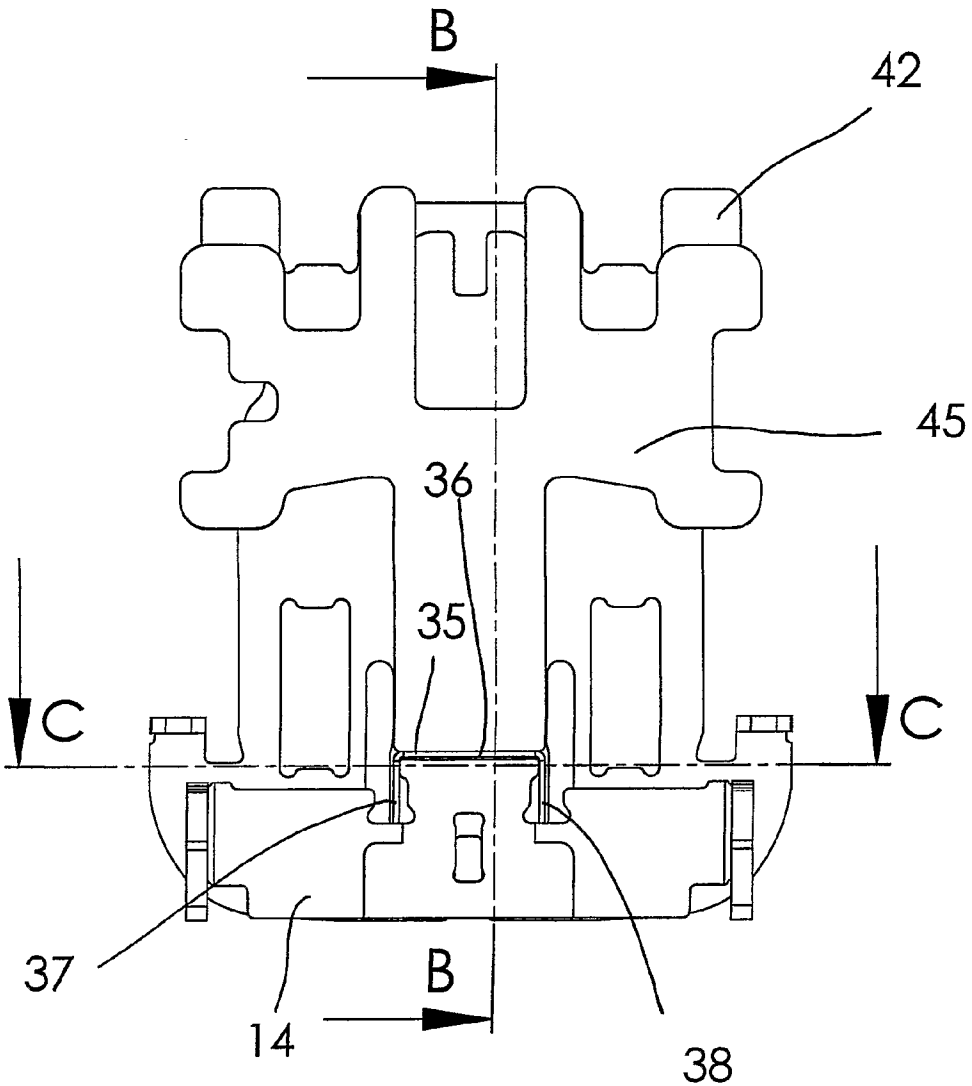
FIG. 13 is a view showing in detail parts essential to the invention.
Figure 14:
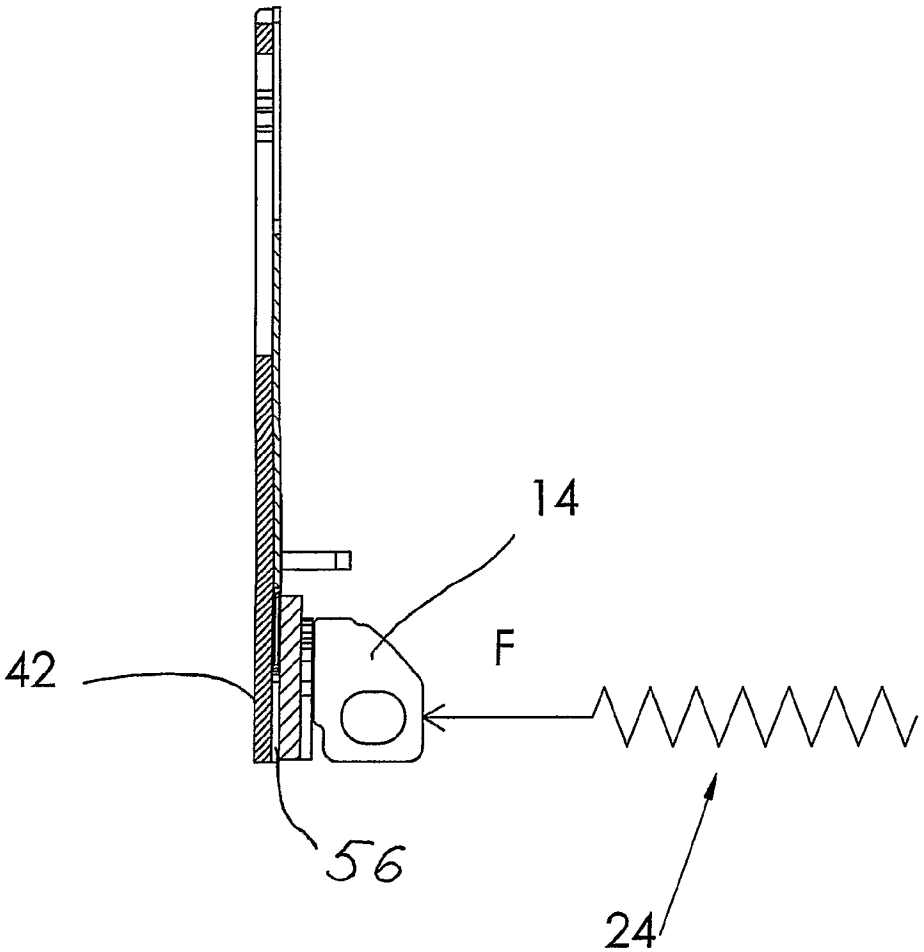
FIG. 14 is a view through section B-B in FIG. 12.
Figure 15:
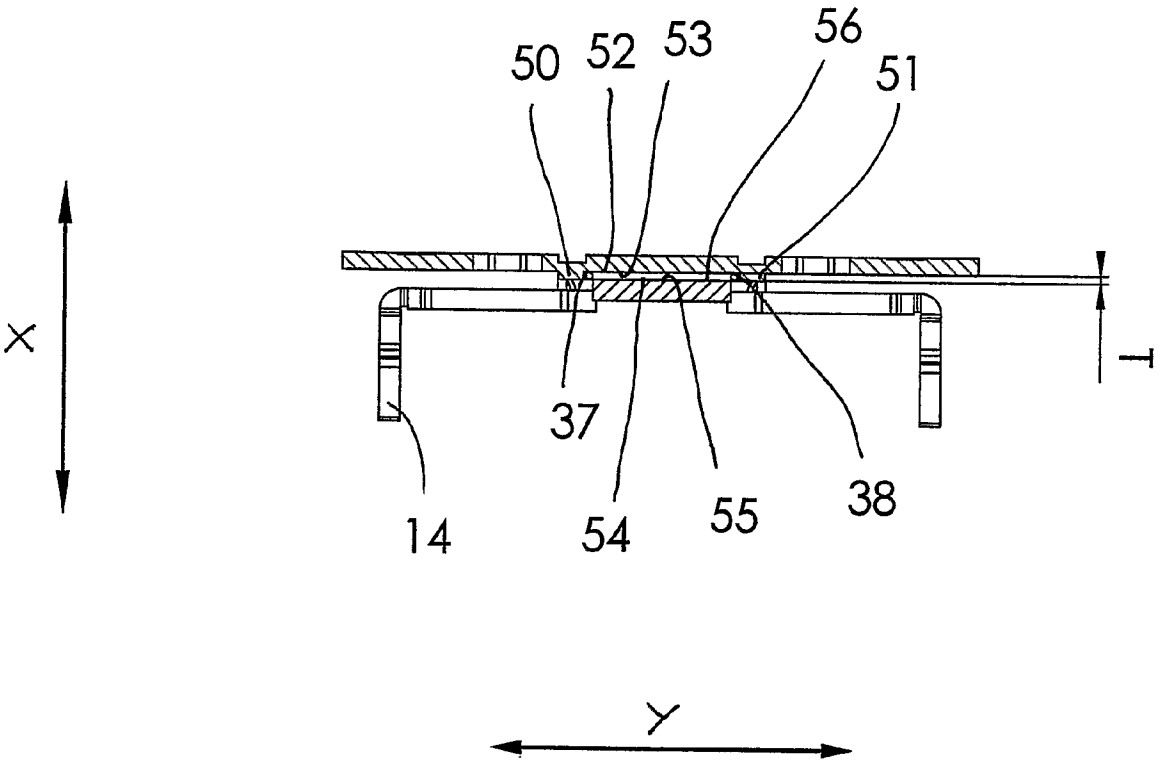
FIG. 15 is a view through section C-C in FIG. 12.

In FIGS. 13-15, the forming block 14, driver 45 and front plate 42 are shown in detail in the positions in which they are located relative to each other when the staple cassette 9 is fitted to the frame 8. The figures also show a staple blank bent into staple form 35 which, through its crown 36, is in contact with the driver 45. In FIG. 14, the arrow F indicates schematically how the elastic elements 24 press the forming block in the direction of the front plate 42 which, by virtue of the connection of the front part 40 to the frame 8 by means of the attachment devices 10, is prevented from moving in the direction in which the forming block is moved by the elastic elements. FIG. 15 shows that the spacing elements 50,51, which oppose the force of the elastic elements 24 as shown in FIG. 13, maintain a clearance T between a first guide surface 52, which is provided with a first face 53 disposed on the front plate 42 and a second guide surface 54, which is provided with a second face 55 disposed on the forming block 14, and that this clearance forms the outlet channel 56 to which staples 35 are fed and through which the driver drives the staple 35. Since the second guide surface 54 is provided on the forming block, which is movable relative to the frame, and the first guide surface 52 is provided on the cassette, which is non-movably connected to the frame by attachment devices, the surfaces are movable relative to each other in a direction toward and away from each other. Although only the staple legs 37 and 38 are shown in FIG. 15, it will be clear to one skilled in the art that the staple crown 36 extends between the respective legs in the direction indicated by the double arrow y. The faces 53 and 55 guide the staple 35 as it is driven through the outlet channel in the direction indicated by the double arrow x, which is transverse to the longitudinal direction of the staple crown 36. Since the clearance T is maintained by the force of the elastic elements 24, the driver 45 which drives the staple 35 through the outlet channel is prevented from losing its grip on the crown 36, which can occur if the clearance T is greater than the clearance determined by the spacing elements 50,51. The fact that the elastic elements 24, as shown in FIG. 11, press the feeding device 13 and the forming block 14 away from the frame 8 in the direction U when the staple cassette 9 is not fitted to the frame 8 ensures that the guide surfaces 52,54 are positioned facing each other the correct distance apart, since the spacing elements 50,51 provided on the cassette 9 come into contact with the guide surface 54 on the forming block 14, thereby pressing the forming block 14 and guide surface 54 backward against the force F when the cassette 9 is fitted to the hook-type attachment devices 10 without the necessity of checking the clearance T after the cassette has been fitted to the frame.

The invention claimed is:

1. A stapler for stapling together a workpiece, comprising:

a stapling unit; and an anvil, which interacts with the stapling unit, on which the workpiece is placed, and against which stapling is performed, the stapling unit and the anvil being driven relative to each other in a reciprocating stapling movement by a drive mechanism, during which movement stapling takes place, wherein the stapling unit includes a frame and a staple cassette, the staple cassette housing staple blanks, being exchangeable, and being detachably attached to the frame by attachment devices, wherein the staple blanks are fed one by one to an outlet channel by a feeding device incorporated in the stapler, a staple which has been fed and formed into staple shape during the stapling movement being driven through the outlet channel by a blade-shaped driver so as to staple the workpiece, the driver being driven by drive links driven by the drive mechanism and acting on a crown of the formed staple, wherein the outlet channel is, in a direction which is transverse to a longitudinal direction of the crown of the formed staple, defined by a first guide surface and a second guide surface, the first guide surface having a first face disposed on the staple cassette, the second guide surface having a second face disposed on the frame, the first and second faces guiding the formed staple as it is driven through the outlet channel, a clearance between the first and second faces being determined by spacing elements, wherein at least one of the first and second guide surfaces is movable toward and away from the other of the first and second guide surfaces and is biased toward the other by one or more elastic elements.

2. A stapler according to claim 1, wherein the second guide surface is movable toward and away from the first guide surface and is biased toward the first guide surface by the one or more elastic elements.

3. A stapler according to claim 2, wherein when the staple cassette is detached from the frame, the second guide surface is biased by the one or more elastic elements to a different position from that in which it is located when the staple cassette is attached to the frame.

4. A stapler according to claim 3, wherein the one or more elastic elements include a helical spring.

5. A stapler according to claim 2, wherein the one or more elastic elements include a helical spring.

6. A stapler according to claim 1, wherein when the staple cassette is detached from the frame, the second guide surface is biased by the one or more elastic elements to a different position from that in which it is located when the staple cassette is attached to the frame.

7. A stapler according to claim 3, wherein the one or more elastic elements include a helical spring.

8. A stapler according to claim 1, wherein the one or more elastic elements include a helical spring.

9. A stapling unit comprising:

a frame; and a staple cassette, which holds staple blanks and is releasably attached to the frame so as to be replaceable, the staple blanks being fed from the staple cassette to an outlet channel, the outlet channel guiding a formed staple blank to a workpiece to be stapled during a stapling motion and being formed by a surface of the staple cassette and a surface of the frame opposed thereto, wherein at least one of said surface of the staple cassette and said surface of the frame is elastically biased toward the other, and a minimum distance between said surface of the staple cassette and said surface of the frame is set by one or more spacers.

10. A stapling unit according to claim 9, wherein said surface of the frame is elastically biased toward said surface of the staple cassette.

11. A stapling unit according to claim 9, wherein the one or more spacers are arranged between said surface of the frame and said surface of the staple cassette.

12. A stapling unit according to claim 9, wherein said surface of the staple cassette and said surface of the frame are maintained at said minimum distance throughout the stapling motion.

13. A stapling unit according to claim 9, wherein the frame includes a forming block constructed to shape staple blanks, and said surface of the frame includes at least a portion of the forming block.

14. A stapling unit according to claim 13, wherein the forming block is biased toward the staple cassette.

15. A stapling unit according to claim 13, wherein the forming block is moveable independent of other portions of the frame.

16. A stapling unit according to claim 9, wherein said surface of the stapling cassette includes a front plate of the stapling cassette.

17. A stapling unit according to claim 16, wherein the one or more spacers includes guide strips formed on the front plate so as to guide the formed staple laterally when the formed staple is driven through the outlet channel during the stapling movement.

18. A stapler for stapling together a workpiece, the stapler comprising:

a frame constructed to releasably support a staple cassette, which holds staple blanks, such that an outlet channel is formed by a surface of the frame and an opposing surface of the staple cassette, the outlet channel guiding a formed staple blank to the workpiece during a stapling motion, wherein said surface of the frame is elastically biased toward said opposing surface of the staple cassette when the staple cassette is supported by the frame, and a forming block is biased toward said opposing surface of the staple cassette.

19. A stapler according to claim 18, wherein the frame includes the forming block, which is constructed to shape staple blanks, and said surface of the frame includes at least a portion of the forming block.

20. A stapler according to claim 18, further comprising an anvil constructed to support the workpiece during the stapling motion and against which stapling of the workpiece is performed.

21. A stapler according to claim 20, further comprising a drive mechanism adapted to drive the frame and the anvil relative to each other in a reciprocating stapling motion.

22. A stapler according to claim 18, further comprising a staple feeding device adapted to feed staple blanks from a staple cassette supported by the frame toward the outlet channel.

23. A stapler according to claim 18, further comprising a staple driver adapted to drive a formed staple through the outlet channel so as to staple the workpiece.

* * * * *